US010695799B2

(12) United States Patent
Oda

(10) Patent No.: US 10,695,799 B2
(45) Date of Patent: Jun. 30, 2020

(54) CONTROL METHOD FOR VIBRATION-TYPE ACTUATOR CAPABLE OF AVOIDING BECOMING INOPERABLE DURING OPERATION, VIBRATION-TYPE DRIVING APPARATUS, AND ELECTRONIC APPARATUS

(71) Applicant: CANON KABUSHIKI KAISHA, Tokyo (JP)

(72) Inventor: Yuki Oda, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 344 days.

(21) Appl. No.: 15/704,470

(22) Filed: Sep. 14, 2017

(65) Prior Publication Data

US 2018/0093299 A1 Apr. 5, 2018

(30) Foreign Application Priority Data

Oct. 5, 2016 (JP) ..... 2016-197199

(51) Int. Cl.
*B06B 1/06* (2006.01)
*B06B 1/02* (2006.01)

(52) U.S. Cl.
CPC ..... *B06B 1/0648* (2013.01); *B06B 1/0207* (2013.01)

(58) Field of Classification Search
CPC ..... B06B 1/0648; B06B 1/0207
USPC ..... 310/311
See application file for complete search history.

(56) References Cited

U.S. PATENT DOCUMENTS 8,134,634 B2 * 3/2012 Kim ..... G02B 7/102 348/340
9,099,941 B2 * 8/2015 Kojima ..... H02N 2/0015
2007/0035202 A1 * 2/2007 Imai ..... G02B 7/10 310/311
2009/0205178 A1 * 8/2009 Kobayashi ..... H03H 3/02 29/25.35
2014/0016014 A1 * 1/2014 Yokoyama ..... H02N 2/0015 348/335

FOREIGN PATENT DOCUMENTS

JP H0795778 A 4/1995
JP 5328259 B2 10/2013

* cited by examiner

*Primary Examiner* — Bryan P Gordon
(74) *Attorney, Agent, or Firm* — Rossi, Kimms & McDowell LLP

(57) ABSTRACT

A control method for a vibration-type actuator which prevents the vibration-type actuator from becoming inoperable during operation. To drive the vibration-type actuator when a load for moving a vibrating body and a driven body relatively to each other is relatively high, a first frequency falling within a frequency range including a frequency at which thrust of the vibration-type actuator reaches its peak is set as a starting frequency of AC voltage applied to an electro-mechanical energy conversion element of the vibrating body. To drive the vibration-type actuator when the load is relatively low, a third frequency lower than the first frequency and higher than a second frequency is set as the starting frequency, the second frequency being a frequency at which a moving speed at which the driving body and the driven body move relatively to each other reaches its peak.

11 Claims, 13 Drawing Sheets

FIRST VIBRATION MODE

SECOND VIBRATION MODE

CONTROL METHOD FOR VIBRATION-TYPE ACTUATOR CAPABLE OF AVOIDING BECOMING INOPERABLE DURING OPERATION, VIBRATION-TYPE DRIVING APPARATUS, AND ELECTRONIC APPARATUS

BACKGROUND OF THE INVENTION

Field of the Invention

The present invention relates to a control method for a vibration-type actuator, a vibration-type driving apparatus, and an electronic apparatus.

Description of the Related Art

Various types of vibration-type actuators are known which bring a vibrating body and a driven body into pressure contact with each other and excite predetermined driving vibrations in the vibrating body to move the vibrating body and the driven body relatively to each other. FIGS. 12A to 12D are views useful in briefly explaining an outline of an arrangement of a vibration-type actuator 300, which is an exemplary vibration-type actuator of a linearly driving type, and a driving principle of the vibration-type actuator 300. A translational driving apparatus according to an embodiment of the present invention, to be described later, is configured using the vibration-type actuator 300, and hence a description will now be given of the arrangement of the vibration-type actuator 300 and the driving principle thereof.

FIG. 12A is a perspective view schematically showing the arrangement of the vibration-type actuator 300. FIG. 12B is a view useful in explaining electrode patterns formed on a piezoelectric element 304 constituting the vibration-type actuator 300 and their polarizing directions. FIG. 12C is a view useful in explaining a first vibration mode of vibrations excited in a vibrating body 305 constituting the vibration-type actuator 300. FIG. 12D is a view useful in explaining a second vibration mode of vibrations excited in the vibrating body 305.

The vibration-type actuator 300 has the vibrating body 305 and a driven body 301. The vibrating body 305 has an elastic body 303, two projecting portions 302, and the piezoelectric element 304. Here, the vibrating body 305 is fixed to a fixing means, not shown, for the convenience of explanation, and it is assumed that the driven body 301 moves relatively to the vibrating body 305. The projecting portions 302 are formed on one side of the elastic body 303, which has a rectangular flat shape, and integrally with the elastic body 303, or joined to the one side of the elastic body 303 by welding or the like. The piezoelectric element 304 which is an electro-mechanical energy conversion element is joined to the other side of the elastic body 303 which is opposite to the side on which the projecting portions 302 are formed, with an adhesive agent or the like. The vibrating body 305 and the driven body 301 are brought into pressure contact with each other in a projecting direction (Z direction) of the projecting portions 302 by a pressurization means, not shown as a pressurizing direction.

By generating vibrations in a first vibration mode and a second vibration mode in the vibrating body 305 through application of two-phase AC voltages VA and VB to the piezoelectric element 304, the driven body 301 being in pressure contact with the projecting portions 302 is caused to move in a driving direction (X direction) connecting the two projecting portions 302 together. Specifically, in the piezoelectric element 304, two equal electrode areas are formed in the X direction connecting the two projecting portions 302 together, and polarizing directions of the electrode areas are the same (+). In the piezoelectric element 304, the AC voltage VB is applied to a right-side one of the two electrode areas in FIG. 12B, and the AC voltage VA is applied to a left-side one of the two electrode areas in FIG. 12B.

Assuming that the AC voltages VA and VB are of a frequency close to a resonance frequency in the first vibration mode and in the same phase, the entire piezoelectric element 304 expands at one moment and contracts at another moment. As a result, vibrations in the first vibration mode shown in FIG. 12C are excited in the vibrating body 305. Here, the projecting portions 302 are provided close to an anti-node of the vibration in the first vibration mode, and therefore, the projecting portions 302 are vibrated (displaced) in the Z direction. Assuming that the AC voltages VA and VB are of a frequency close to a resonance frequency in the second vibration mode and 180° out of phase with each other, the right-side electrode area of the piezoelectric element 304 contracts and the left-side electrode area of the piezoelectric element 304 expands at the same time at one moment, and this is the other way around at another moment. As a result, vibrations in the second vibration mode are excited in the vibrating body 305. Here, the projecting portions 302 are provided close to a node of the vibration in the second vibration mode, and therefore, the projecting portions 302 are vibrated (displaced) in the X direction.

Thus, by applying the AC voltages close to the respective resonance frequencies in the first vibration mode and the second vibration mode to the electrodes of the piezoelectric element 304, resultant vibrations of the vibrations in the first vibration mode and the second vibration mode are excited in the vibrating body 305. This produces oval motions of the projecting portions 302 within a Z-X plane. The driven body 301 is frictionally driven by the oval motions of the projecting portions 302 and moves in the X direction relatively to the vibrating body 305.

By changing a phase difference between the two-phase AC voltages VB and VA, an amplitude ratio between an amplitude of the first vibration mode and an amplitude of the second vibration mode is changed, and as a result, a speed (moving speed) of the driven body 301 is adjusted. A method for controlling the speed of the driven body 301 by changing the phase difference between the two-phase AC voltages VB and VA is described in Japanese Patent Publication No. 5328259. FIGS. 13A and 13B are diagrams showing a relationship among phase difference, frequency, and speed when the vibration-type actuator 300 is driven. FIG. 13A shows a relationship between control amount and phase difference and frequency. Here, in a region where absolute values of control amounts are small, the phase difference is changed (phase difference control region), and in a region where absolute values of control amounts are large, the frequency is changed (frequency control region). Namely, the phase difference control and the frequency control are switched according to control amounts. In the phase difference control region, the frequency is fixed at an upper limit frequency, and a phase difference is adjusted within a range from an upper limit frequency to a lower limit phase difference (for example, from +120 degrees to −120 degrees) to control reversal of the driving direction, stop, and speed in a low-speed region. In the frequency control region, the frequency is fixed at a lower limit frequency or an upper limit frequency, and frequencies are adjusted within a range from the upper limit frequency to the lower limit frequency (for example, from 98 kHz to 95 kHz) to control speed in a high-speed region.

FIG. 13B shows how the speed of the driven body 301 varies with control amounts. The phase difference control is provided in a low-speed region (−50 mm/s to +50 mm/s), and the frequency control is provided in high-speed regions other than the low-speed region. In the phase-difference control, oval motions produced in the projecting portions 302 are controlled such that oval ratios are changed, and directions of the oval motions are switched by reversing signs of phase differences. In the frequency control, oval amplitudes are controlled such that the oval amplitudes vary with oval ratios of the oval motions being kept constant. On this occasion, a phase difference and a frequency are determined so that a speed of the driven body 301 can be as linear as possible with respect to a control amount. It is known that at this time, characteristics of the vibration-type actuator 300 vary depending on an upper limit frequency setting, and an upper limit frequency is set as described in, for example, Japanese Laid-Open Patent Publication (Kokai) No. H07-95778.

According to the technique described in Japanese Patent Publication No. 5328259 above, the speed is increased until a desired speed is reached by providing control such that the vibration-type actuator is started with an upper limit frequency (hereafter referred to as a "starting frequency") set at a higher frequency than a resonance frequency, and a driving frequency is lowered. According to the technique described in Japanese Laid-Open Patent Publication (Kokai) No. H07-95778 above, a load on the vibration-type actuator is determined, and a starting frequency is set according to this load. Specifically, when the load is low, a low starting frequency is set so as to quickly start the vibration-type actuator, and when the load is high, a high starting frequency is set so as to prevent a situation in which the vibration-type actuator cannot be started.

However, even in the case where an optimum starting frequency is set according to the load, the control that lowers the driving frequency may cause thrust (torque) to be decreased when the driving frequency is lowered, making the vibration-type actuator inoperable. Moreover, even in the case where the starting frequency is optimized in combination with the phase difference control, the control to lower the driving frequency is provided when the speed lowers due to, for example, an increase in the load during operation. In this case as well, thrust decreases when the driving frequency is lowered, and hence thrust for driving the driven body against the load may not be obtained, resulting in the vibration-type actuator becoming inoperable.

SUMMARY OF THE INVENTION

The present invention provides a control method for a vibration-type actuator, which is capable of preventing the vibration-type actuator from becoming inoperable during operation, a vibration-type driving apparatus, and an electronic apparatus.

Accordingly, the present invention provide a vibration-type driving apparatus comprising a vibration-type actuator configured to have a vibrating body that has an electro-mechanical energy conversion element, and a driven body that is in contact with the vibrating body, and move the vibrating body and the driven body relatively to each other by exciting vibrations in the vibrating body through application of AC voltage to the electro-mechanical energy conversion element, and a control device configured to control the vibration-type actuator by controlling the AC voltage, wherein, to drive the vibration-type actuator in a case where a load for moving the vibrating body and the driven body relatively to each other is relatively high, the control device sets a first frequency, which falls within a frequency range including a frequency at which thrust of the vibration-type actuator reaches its peak, as a starting frequency of the AC voltage, and to drive the vibration-type actuator in a case where the load for moving the vibrating body and the driven body relatively to each other is relatively low, the control device sets a third frequency lower than the first frequency and higher than a second frequency as the starting frequency of the AC voltage, the second frequency being a frequency at which a moving speed at which the driving body and the driven body move relatively to each other reaches its peak.

According to the present invention, the vibration-type actuator is prevented from becoming inoperable during operation.

Further features of the present invention will become apparent from the following description of exemplary embodiments (with reference to the attached drawings).

DESCRIPTION OF THE EMBODIMENTS

Hereafter, an embodiment of the present invention will be described with reference to the drawings. In the following description of the present embodiment, a translational driving apparatus with a driving unit configured using a vibration-type actuator having the same arrangement as that of the vibration-type actuator 300 described above with reference to FIGS. 12A to 12D is taken up as a vibration-type driving apparatus according to the present invention. First, a description will be given of an arrangement of the driving unit which the translational driving apparatus has.

Figure 1A:
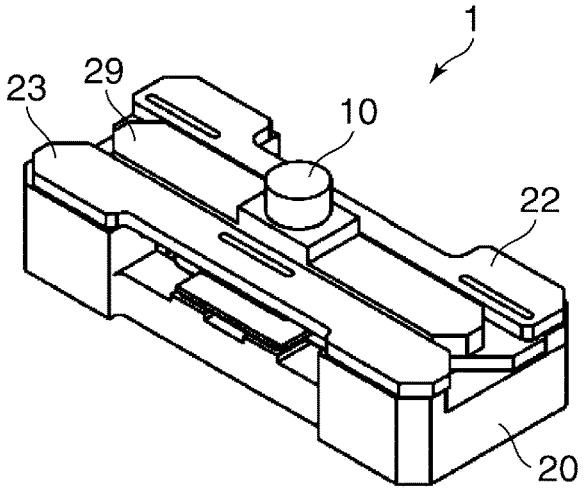
FIGS. 1A and 1B are a perspective view and an exploded perspective view, respectively, schematically showing an arrangement of driving units.
Figure 1B:
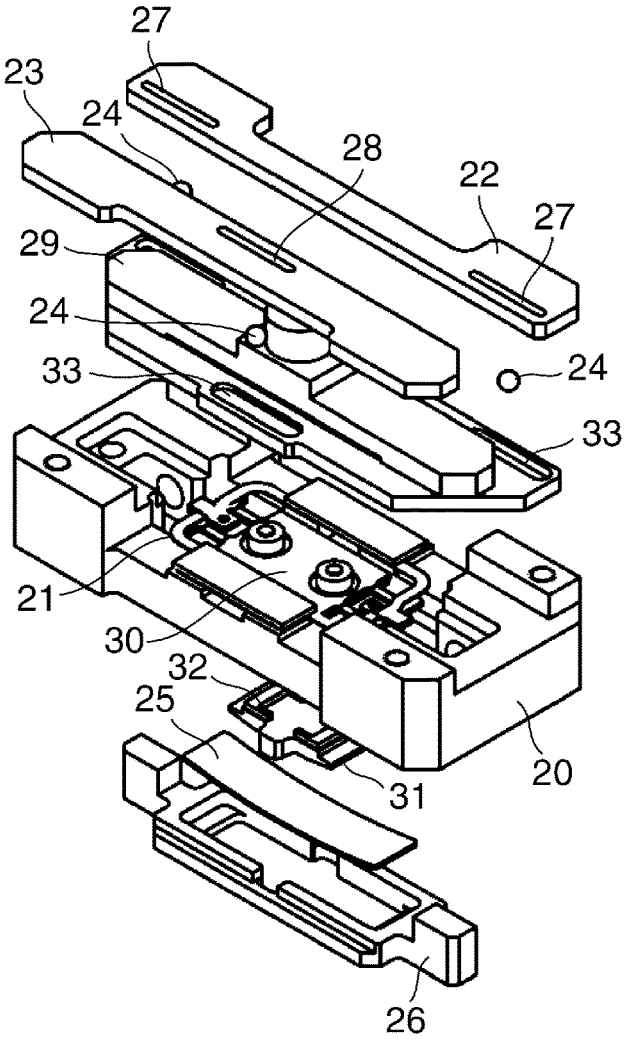

FIG. 1A is a perspective view schematically showing an arrangement of a driving unit 1 used for the translational driving apparatus. FIG. 1B is an exploded perspective view showing the driving unit 1. The driving unit 1 is constructed by forming a vibration-type actuator having a vibrating body 30 and a slider 29, which is a driven body, into a unit so that it can be installed in the translational driving apparatus. A basic arrangement of the vibrating body 30 conforms with that of the vibrating body 305 described earlier with reference to FIGS. 12A to 12D. Namely, the vibrating body 30 has a flat-shaped elastic body, an electro-mechanical energy conversion element (piezoelectric element) which is provided on one side of the elastic body, and projecting portions which are provided on the other side of the elastic body and brought into pressure contact with the slider 29, and description of its operating principle and others is omitted. The slider 29 corresponds to the driven body 301 described above with reference to FIGS. 12A to 12D.

In the driving unit 1, an output shaft 10 is provided on an upper surface (a surface opposite to a surface frictionally sliding in contact with the vibrating body 30) of the slider 29, which is frictionally driven by the vibrating body 30, so that output can be taken out through the output shaft 10. Both ends of the vibrating body 30 in a longitudinal direction are connected to an elastic body 21 with lower stiffness than that of the elastic body constituting the vibrating body 30 (corresponding to the elastic body 303 of the vibrating body 305), and a part of the elastic body 21 is fixed to a base 20. Thus, the vibrating body 30 has flexibility in a rolling direction with respect to a driving direction (direction that connects the two projecting portions (corresponding to the projecting portions 302 of the vibrating body 305) together) and is able to follow a surface of the slider 29. As a result, the slider 29 and the vibrating body 30 are maintained stably in pressure contact with each other.

Three rolling balls 24 are able to roll while being sandwiched by three ball receiving portions 33 formed in the slider 29, and two groove portions 27 formed in a first fixed rail 22 and one groove portion 28 formed in a second fixed rail 23. The first fixed rail 22 and the second fixed rail 23 are fixed to the base 20, and this determines a driving direction and position of the slider 29. It should be noted that a driving direction and position of the slider 29 should not necessarily be determined using the rolling balls 24, but may be determined using members capable of linearly moving such as slide rails.

A pressing member 31 receives pressure applied by a leaf spring 25 to bring the vibrating body 30 into pressure contact with the slider 29 via a vibration insulating member 32 attached to the pressing member 31. The pressure applied by the leaf spring 25 is determined by a leaf spring holding member 26 being fixed at a predetermined position of the base 20. It should be noted that the vibration insulating member 32 may be attached to the vibrating body 30, not to the pressing member 31. A compression coil spring, a conical spring, or the like may be used in place of the leaf spring 25. In the driving unit 1, the slider 29 is movable in a longitudinal direction of the driving unit 1 by exiting vibrations in the first vibration mode and the second vibration mode described above with reference to FIGS. 12C and 12D in the vibrating body 30 with a predetermined phase difference.

Figure 2:
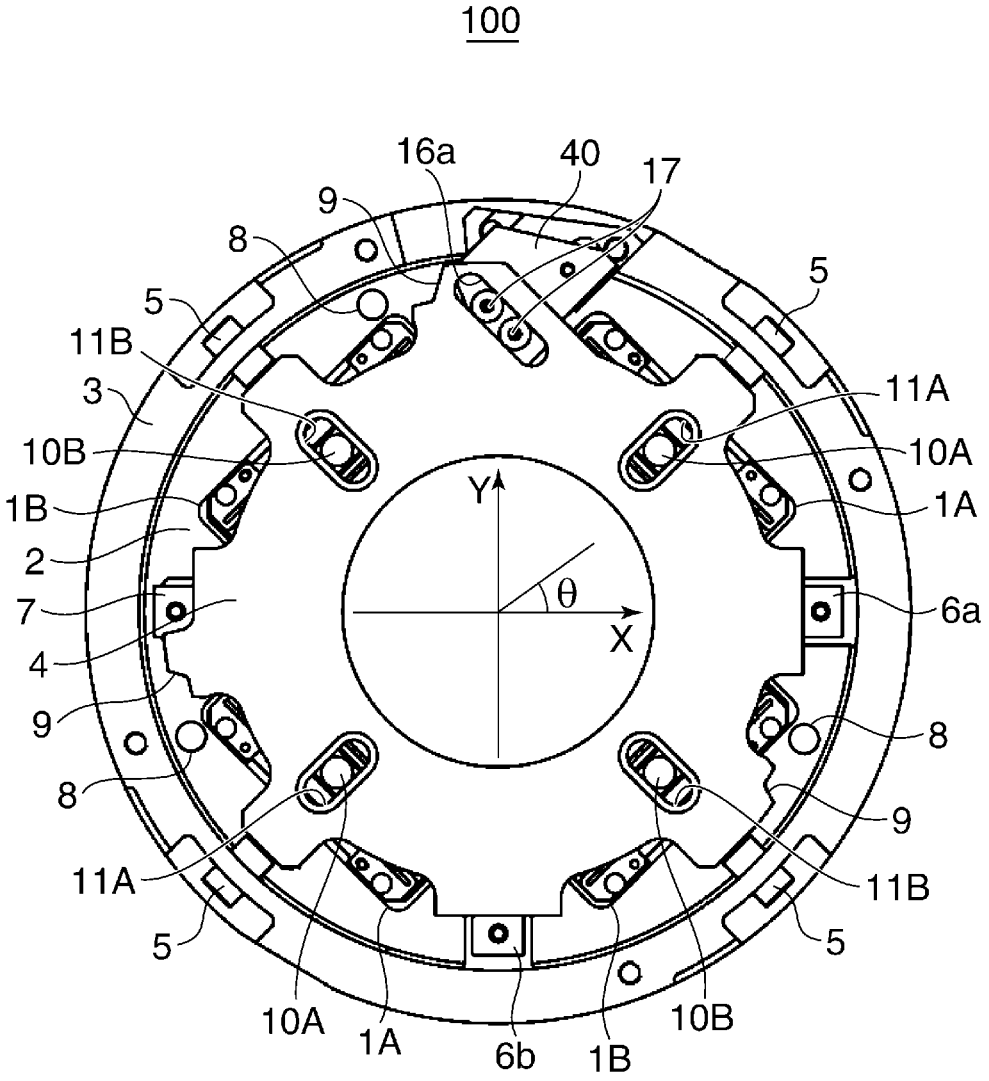
FIG. 2 is a plan view schematically showing an arrangement of a translational driving apparatus using the driving units.

Next, a description will be given of the translational driving apparatus using the driving unit 1. FIG. 2 is a plan view schematically showing an arrangement of the translational driving apparatus 100. For the convenience of explanation, an orthogonal coordinate system (an x-axis, a y-axis) is defined as shown in FIG. 2. It should be noted that a thickness direction of the translational driving apparatus 100 is a direction of a z-axis (not shown) which is perpendicular to both of the directions of the x-axis and the y-axis.

The translational driving apparatus 100 has driving units 1A and 1B, a supporting member 2, a fixing member 3, a moving body 4, first displacement sensors 6*a* and 6*b*, a second displacement sensor 7, and a rotation restraining unit 40. The driving units 1A and 1B are each substantially the same as the driving unit 1 described above with reference to FIGS. 1A and 1B, and therefore, detailed description thereof is omitted. Each of the two driving units 1A is mounted on the supporting member 2 such that a driving direction of an output shaft 10A crosses the x-axis and the y-axis at substantially the same angle within an XY plane. Each of the two driving units 1B is mounted on the supporting member 2 such that a driving direction of an output shaft 10B is substantially perpendicular to the driving direction of the output shaft 10A within the XY plane. The supporting member 2 is placed so as to be relatively rotatable with respect to the fixing member 3 within the XY plane, and is placed so as to cause virtually no displacement respect to the fixing member 3 in the direction of the z-axis.

The moving body 4 has supporting rollers 5, which are engaged with roller receiving portions provided in the fixing member 3. The roller receiving portions have a predetermined length in a circumferential direction of the fixing member 3, and they are slot-shaped so as to restrain movement of the supporting rollers 5 in the direction of the z-axis. This enables the supporting rollers 5 to smoothly slide within the roller receiving portions. The output shafts 10A and 10B (corresponding to the output shaft 10 of the driving unit 1) of the driving units 1A and 1B are engaged with slot-shaped thrust receiving portions 11A and 11B, respectively, which are provided in the moving body 4. Longitudinal directions of the thrust receiving portions 11A and 11B are perpendicular to the driving directions of the output shafts 10A and 10B, respectively. In order for the output shafts 10A and 10B to receive substantially no pressing force in the direction of the z-axis from the thrust receiving portions 11A and 11B, the thrust receiving portions 11A and 11B are designed such that their width (length in a crosswise direction) is equal to an outer diameter of the output shafts 10A and 10B.

Thus, when the driving units 1A and 1B are driven, the moving body 4 does not receive thrust from anything other than the driving units 1A and 1B but receives thrust from the output shafts 10A and 10B through the thrust receiving portions 11A and 11B and moves within the XY plane. Namely, in the translational driving apparatus 100, the moving body 4 is able to move within a predetermined range inside the XY plane while its movement in the direction of the z-axis is restrained due to the supporting rollers 5 and the roller receiving portions being slidably fitted in each other and the output shafts 10A and 10B and the thrust receiving portions 11A and 11B being slidably fitted in each other.

Figure 3:
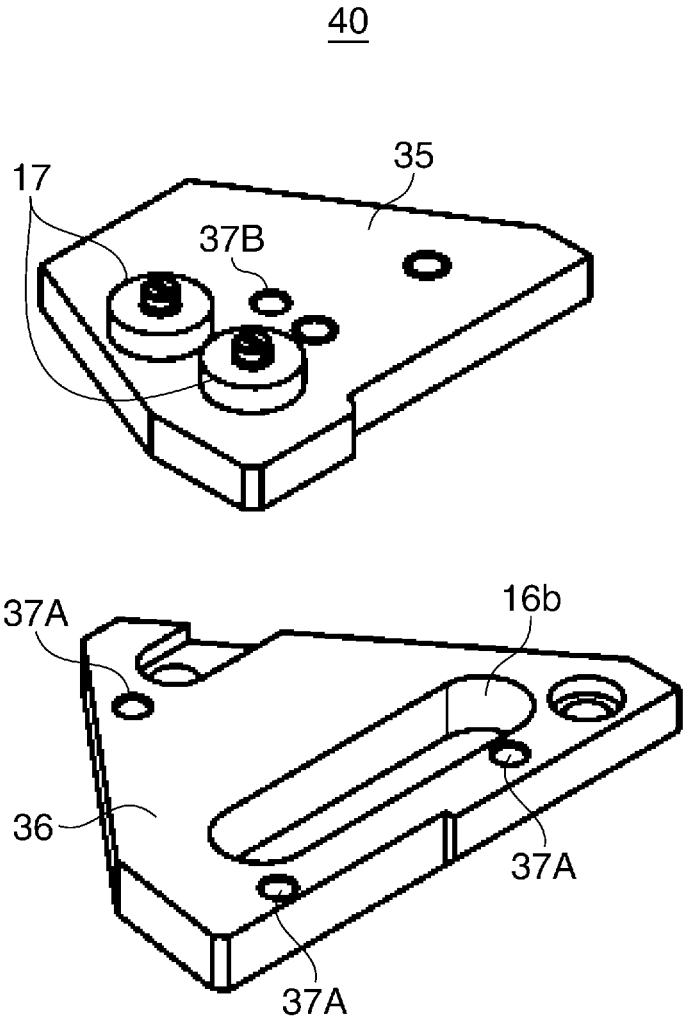
FIG. 3 is an exploded perspective view schematically showing an arrangement of a rotation restraining unit which the translational driving apparatus has.

On the other hand, rotation of the moving body 4 within the XY plane is restrained by the rotation restraining unit 40. FIG. 3 is an exploded perspective view schematically showing an arrangement of the rotation restraining unit 40. The rotation restraining unit 40 has a base 36 and a slide member 35. The rotation restraining unit 40 is mounted on the fixing member 3 by fixing the base 36 to the fixing member 3. In the base 36, a slot-shaped sliding groove portion 16*b* extends in a direction substantially parallel to the driving direction of the output shafts 10B of the driving units 1B while the base 36 is fixed to the fixing member 3. Three ball receiving portions 37A are provided in a surface of the base 36 on the slide member 35 side, and balls (bearings), not shown, are disposed in the respective three ball receiving portions 37A. The balls placed in the ball receiving portions 37A slide in contact with the sliding member 35.

On an upper surface of the slide member 35 (which is opposite to a surface on the base 36 side), two ball bearings 17 are placed side by side in a direction substantially parallel to the driving direction of the output shafts 10A of the driving units 1A while the base 36 is fixed to the fixing member 3. On the upper surface of the slide member 35, one ball receiving portion 37B as well is provided, and a ball (bearing), not shown, is placed in the ball receiving portion 37B. The ball placed in the ball receiving portion 37B slides in contact with the moving body 4. On a lower surface of the slide member 35 (a surface on the base 36 side), two ball bearings, not shown, which have the same structure as that of the two ball bearings 17 and slidably engage with the slot-shaped sliding groove portion 16*a* provided in the moving body 4 are provided.

With the rotation restraining unit 40 mounted on the fixing member 3, the two ball bearings 17 provided on the upper surface of the slide member 35 are slidably engaged with the sliding groove portion 16*a* provided in the moving body 4 as shown in FIG. 2. The two ball bearings, not shown, provided in the lower surface of the slide member 35 are engaged with the sliding groove portion 16*a* provided in the base 36, and this restrains movement of the slide member 35 in a direction parallel to the driving direction of the output shafts 10A. Thus, driving the driving units 1A causes the two ball bearings 17 provided on the upper surface of the slide member 35 to roll inside the sliding groove portion 16*a* and causes the moving body 4 to move in the driving direction of the output shafts 10A. On the other hand, driving the driving units 1B causes the two ball bearings, not shown, provided on the lower surface of the slide member 35 to roll inside the sliding groove portion 16*b* provided in the base 36 and causes the moving body 4 and the slide member 35 to move integrally in the driving direction of the output shafts 10B. Thus, the moving body 4 is able to move in an arbitrary direction in the XY plane while being restrained from rotating in the XY plane by the rotation restraining unit 40.

A positional relationship among the moving body 4, the slide member 35, and the base 36 is properly maintained since in the translational driving apparatus 100, the one ball is placed between the moving body 4 and the slide member 35, and the three balls are placed between the slide member 35 and the base 36. This makes a clearance between the two ball bearings 17 and the sliding groove portion 16*a* and a clearance between the two ball bearings, not shown, and the sliding groove portion 16*b* small to prevent rattling and lighten the sliding load. It should be noted that although in the present embodiment, the ball bearings 17 and the balls are used, bars, sliding bearings, and so forth comprised of materials with low friction coefficients such as PTFE may be used. Moreover, the number of balls is not limited to the above example. Further, longitudinal directions of the sliding groove portions 16*a* and 16*b* provided in the moving body 4 and the rotation restraining unit 40, respectively, should not necessarily correspond to the driving directions of the driving units 1A and 1B as described above, but the longitudinal directions of the sliding groove portions 16*a* and 16*b* may be set in arbitrary directions, for example, substantially parallel to the direction of the x-axis and the direction of the y-axis, respectively.

The first displacement sensors 6*a* and 6*b* are mounted on the fixing member 3. The second displacement sensor 7 is mounted on the supporting member 2. The first displacement sensor 6*a* detects an amount of displacement of the moving body 4 in the direction of the y-axis, the first displacement sensor 6*b* detects an amount of displacement of the moving body 4 in the direction of the x-axis, and the second displacement sensor 7 detects a displacement (rotation angle) of the supporting member 2 in a direction of θ. It should be noted that how the supporting member 2 is rotated with respect to the fixing member 3 so as to lock the moving body 4 at a predetermined position will be described later.

Figure 4A:
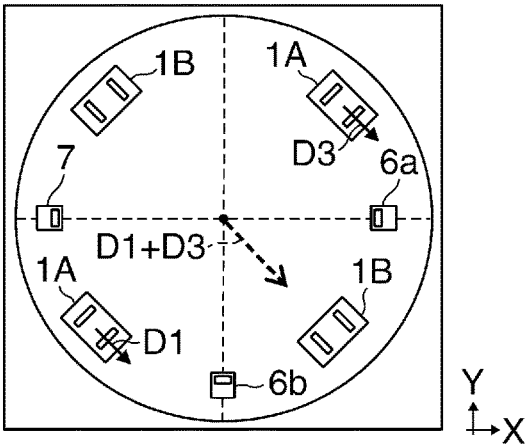
FIGS. 4A to 4E are views schematically showing driving modes of the driving units in the translational driving apparatus.
Figure 4B:
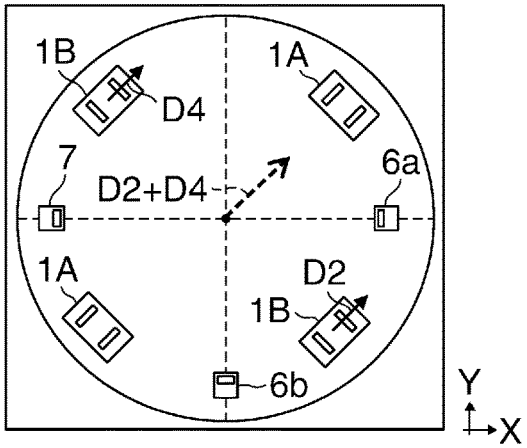

A concrete description will now be given of how to drive the moving body 4. FIGS. 4A to 4E are plan views schematically showing drive modes of the driving units 1A and 1B when the moving body 4 is driven in predetermined directions. FIG. 4A shows a drive mode of the driving units 1A and 1B when the moving body 4 is driven in a direction of θ=315°. In this case, the drive units 1B are not driven, and driving forces D1 and D3 indicated by solid arrows are generated in the respective output shafts 10A of the two driving units 1A. As a result, a resultant D1+D3 of the driving forces D1 and D3 moves the moving body 4 in the direction of 315°. FIG. 4B shows a drive mode of the driving units 1A and 1B when the moving body 4 is driven in a direction of θ=45°. In this case, the drive units 1A are not driven, and driving forces D2 and D4 indicated by solid arrows are generated in the respective output shafts 10B of the two driving units 1B. As a result, a resultant D2+D4 of the driving forces D2 and D4 moves the moving body 4 in the direction of 45°.

Figure 4C:
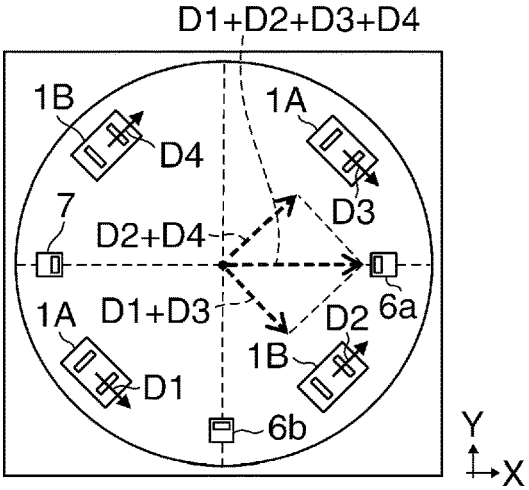
Figure 4D:
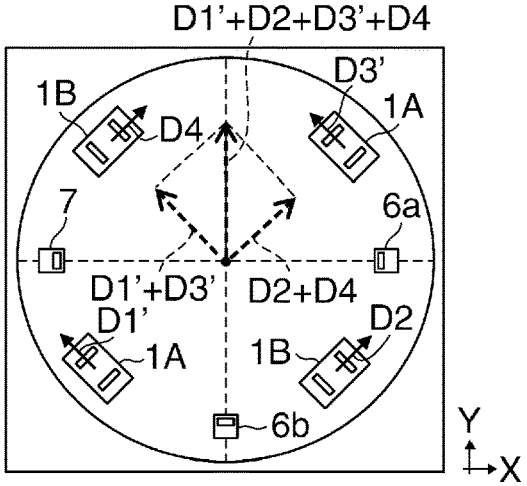

FIG. 4C shows a drive mode of the driving units 1A and 1B when the moving body 4 is driven in a direction of θ=0° (a plus direction in the direction of the x-axis). In this case, the driving forces D1 and D3 indicated by solid arrows are generated in the respective ones of the two driving units 1A, and the driving forces D2 and D4 indicated by solid arrows are generated in the respective ones of the two driving units 1B. As a result, a resultant D1+D2+D3+D4 of the driving forces D1, D2, D3, and D4 moves the moving body 4 in the direction of 0°. FIG. 4*d* shows a drive mode of the driving units 1A and 1B when the moving body 4 is driven in a direction of θ=90° (a plus direction in the direction of the y-axis). In this case, driving forces D1' and D3' indicated by solid arrows are generated in the respective ones of the two driving units 1A, and driving forces D2 and D4 indicated by solid arrows are generated in the respective ones of the two driving units 1B. As a result, a resultant D1'+D2+D3'+D4 of the driving forces D1', D2, D3', and D4 moves the moving body 4 in the direction of 90°.

Figure 4E:
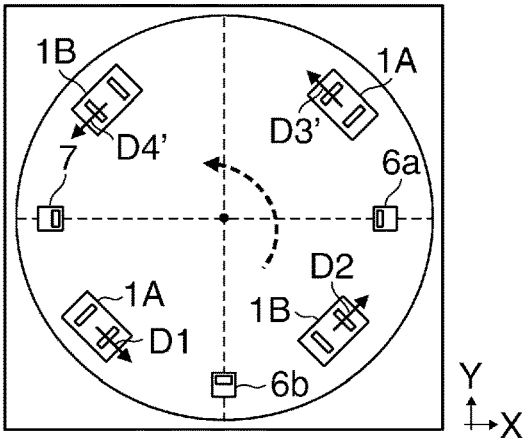

FIG. 4E shows a drive mode of the driving units 1A and 1B when a thrust for rotating the moving body 4 in the XY plane is generated. In this case, the driving forces D1 and D3' indicated by solid arrows are generated in the respective ones of the two driving units 1A, and the driving forces D2 and D4' indicated by solid arrows are generated in the respective ones of the two driving units 1B. As a result, a resultant D1'+D2+D3'+D4 of the driving forces D1', D2, D3', and D4 gives the moving body 4 a thrust for rotating the moving body 4 counterclockwise in the XY plane as indicated by a broken-line arrow in FIG. 4E. As described above, however, rotation of the moving body 4 in the XY plane is restrained by the rotation restraining unit 40. On the other hand, the supporting member 2 on which the driving units 1A and 1B are placed is rotatable with respect to the fixed member 3 in the XY plane. As a result, the driving units 1A and 1B are subjected to a reaction force from the moving body 4, causing the supporting member 2 to rotate in a direction opposite to the direction indicated by the broken-line arrow.

By rotating the supporting member 2 in this manner, the translational driving apparatus 100 is switched between a state in which the moving body 4 is locked (hereafter referred to as "the locked state") and a state in which the moving body 4 is unlocked (hereafter referred to as "the unlocked state"). For example, when the moving body 4 moves unexpectedly while shooting is performed with an image pickup apparatus, which has an image stabilizer using the translational driving apparatus 100, fixed with a tripod or the like, blurring of an image or picture may occur. It is thus necessary to lock (fix) the moving body 4 at a predetermined position so as to prevent the moving body 4 from moving.

Figure 5:
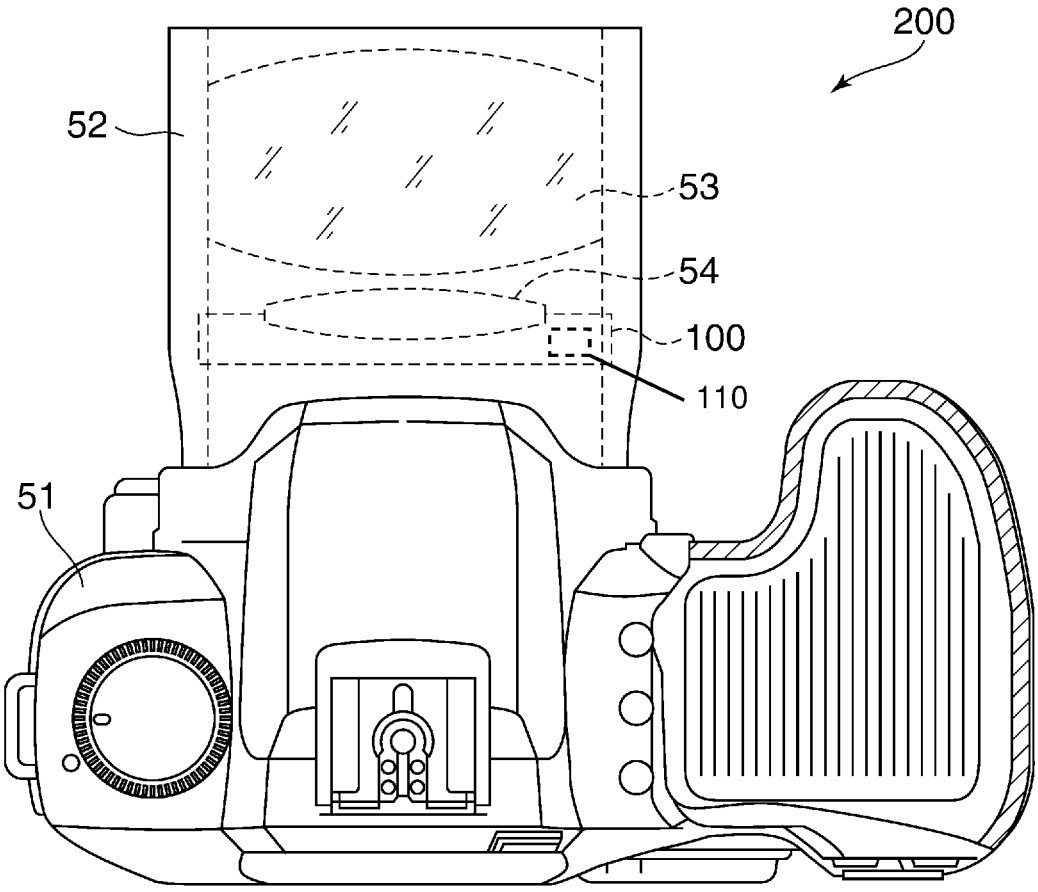
FIG. 5 is a top view useful in briefly explaining an arrangement of an image pickup apparatus having an image stabilizer using the translational driving apparatus.

FIG. 5 is a top view useful in briefly explaining an arrangement of an image pickup apparatus 200 equipped with an image stabilizer using the translational driving apparatus 100. The image pickup apparatus 200 is comprised mainly of an image pickup apparatus main body 51 having an image pickup device (not shown), and a lens barrel 52 attachable to and removable from the image pickup apparatus main body 51. The lens barrel 52 has a plurality of lens groups 53 and the image stabilizer using the translational driving apparatus 100. A bundle of rays passes through the lens barrel 52 to form an optical image on the image pickup device. The image pickup device converts the formed optical image into an electric signal by subjecting it to photoelectrical conversion and outputs the electric signal to an image processing circuit which the image pickup apparatus 200 has. The image processing circuit generates image data from the received electric signal.

The image stabilizer is formed by mounting an image stabilization lens 54 in a central hole of the moving body 4 of the translational driving apparatus 100. The translational driving apparatus 100 is placed on the lens barrel 52 so that the XY plane shown in FIGS. 1A and 1B can be substantially perpendicular to a direction of an optical axis of the lens barrel 52. Thus, by moving the image stabilization lens 54 in a plane perpendicular to the direction of the optical axis, image blurring resulting from came shake or the like is corrected for to take a clear image. It should be noted that the image stabilizer should not necessarily be configured to drive the image stabilization lens 54 in the plane perpendicular to the direction of the optical axis, but may be configured to drive the image pickup device in the plane perpendicular to the direction of the optical axis. In this case, the translational driving apparatus 100 with the moving body 4 in the central hole of which the image pickup device is placed should be disposed in the image pickup apparatus main body 51.

Figure 6:
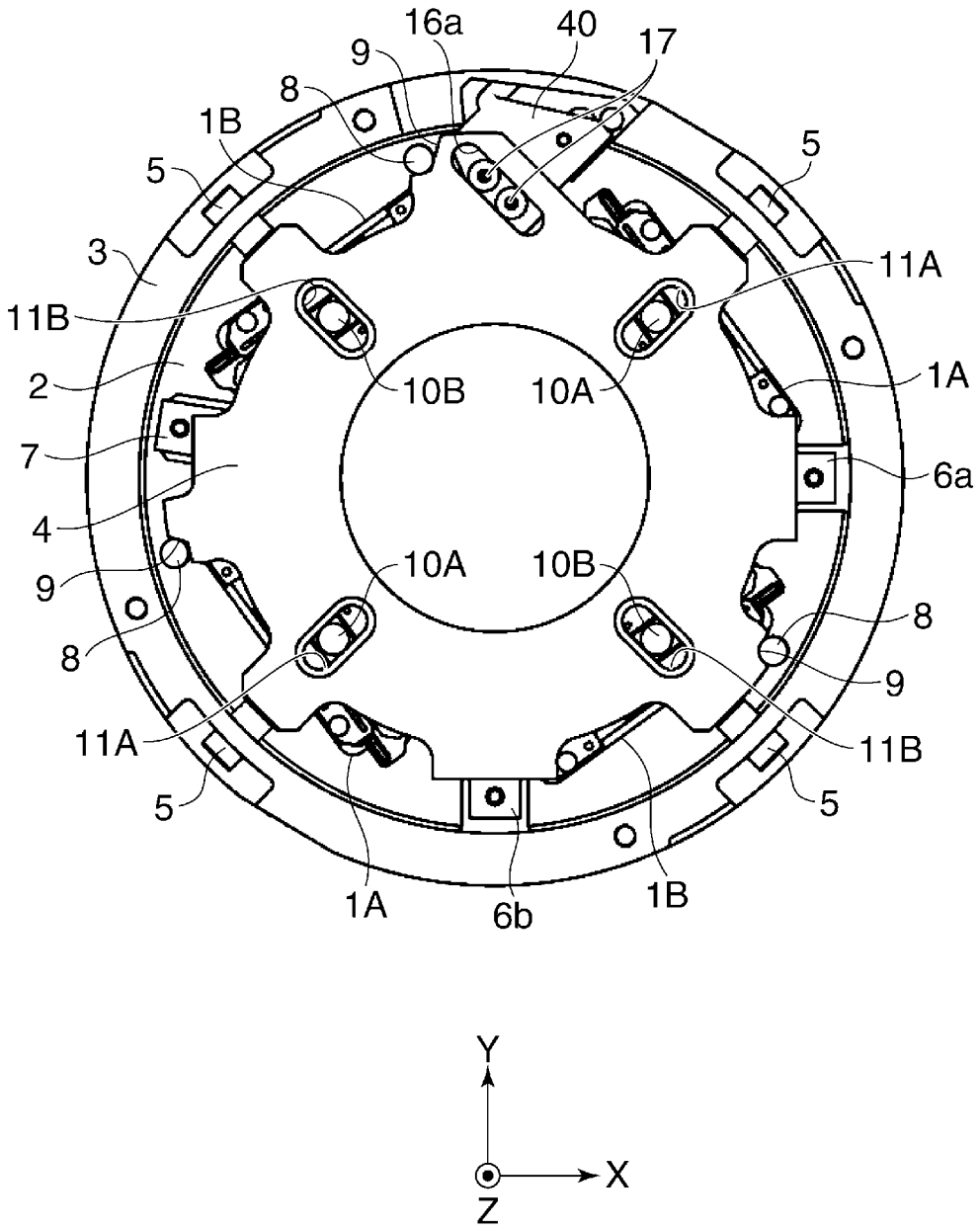
FIG. 6 is a plan view showing the translational driving apparatus with a moving body thereof locked.

FIG. 6 is a plan view showing the translational driving apparatus 100 with the moving body 4 locked. As shown in FIG. 2 as well as FIG. 6, the supporting member 2 of the translational driving apparatus 100 has three engaging pins 8, and the moving body 4 of the translational driving apparatus 100 has three engaging portions 9. As described above with reference to FIG. 4E, trying to rotate the moving body 4 counterclockwise ends up rotating the supporting member 2 clockwise, causing the engaging pins 8 and the engaging portions 9 to engage together and bringing the moving body 4 into the locked state. It should be noted wherever the moving body 4 lies, an outer diameter circle of the supporting member 2 and a hollow circle provided in the center of the moving body 4 are controlled to be concentric circles when the engaging pins 8 and the engaging portions 9 are engaged together.

In order to unlock the locked moving body 4, the supporting member 2 should be rotated counterclockwise. Namely, all the driving forces shown in FIG. 4E should be generated in reverse directions. A rotational angle through which the supporting member 2 is rotated when the moving body 4 is brought from the unlocked state in FIG. 2 to the locked state in FIG. 6 is detected by the second displacement sensor 7, and the detected rotational angle is stored in a control device 110 (see also FIG. 5) of the translational driving apparatus 100. To bring the moving body 4 from the locked state back to the unlocked state, the supporting member 2 should be rotated through a rotational angle equal to the stored rotational angle of the supporting member 2 and in a direction opposite to a direction in which the supporting member 2 is rotated when the moving body 4 is brought from the unlocked state to the locked state. It should be noted that although in the present embodiment, the moving body 4 is locked through the engagement of the engaging pins 8 and the engaging portions 9, the moving body 4 may be locked in any way or by any means as long as it is possible to switch the moving body 4 between the locked state and the unlocked state.

Figure 7:
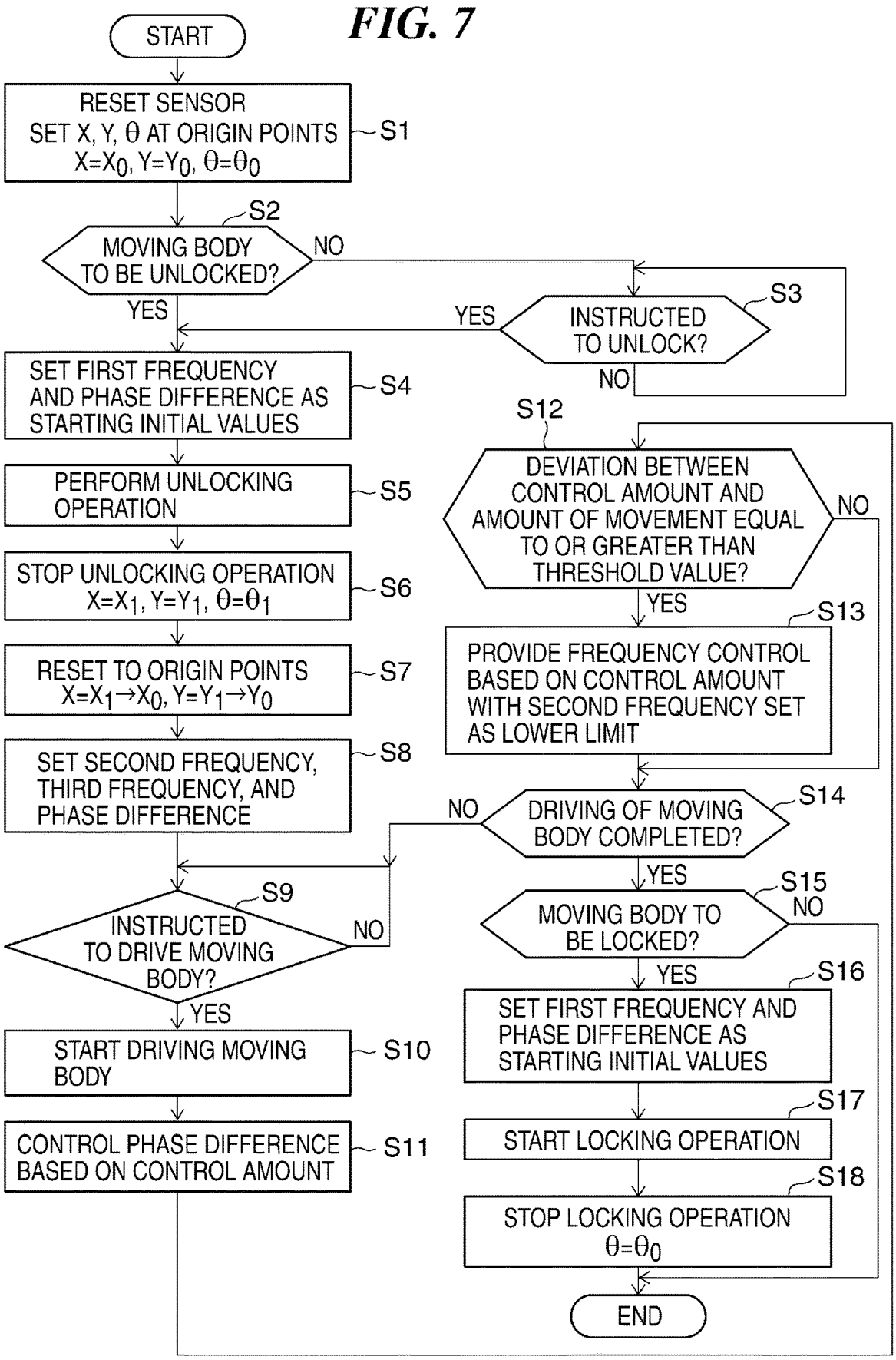
FIG. 7 is a flowchart showing how operation of the translational driving apparatus is controlled.

A description will now be given of how the translational driving apparatus 100 is controlled. FIG. 7 is a flowchart showing how the translational driving apparatus 100 is drivingly controlled. When the power to the electronic apparatus equipped with the translational driving apparatus 100 is off (when the electronic apparatus is not in use), it is preferred that the moving body 4 of the translational driving apparatus 100 is held in the locked state. Accordingly, a process in step S1 is started by switching the electronic apparatus on.

Processes in the flowchart in FIG. 7 are implemented by the control device 110 of the translational driving apparatus 100 controlling operation of the driving units 1A and 1B based on output signals from the first displacement sensors 6*a* and 6*b* and the second displacement sensor 7. The control device 110 has a computation unit, and a power supply circuit which feeds power to the driving units 1A and 1B in accordance with instructions from the computation unit. The computation unit has a CPU, a ROM, a RAM, electronic components, and electric components, and operation of various components constituting the control device 110 is controlled the CPU expanding programs stored in the ROM into the RAM. It should be noted that the computation unit may be a specific processor such as an ASIC which implements all or a part of processes carried out by the components. The computation unit may be implemented by either software (programs) or hardware, or by a combination of software and hardware.

In the step S1, the control device 110 resets origin points of the first displacement sensors 6*a* and 6*b* and the second displacement sensor 7, sets readouts of these sensors to $X=X_0$, $Y=Y_0$, and $\theta=\theta_0$, respectively, and stores these readouts as control origin points. In step S2, the control device 110 judges whether or not to unlock the locked moving body 4. When it is unnecessary to drive the moving body 4, there is no need to unlock the moving body 4. Accordingly, when the control device 110 judges that the moving body 4 is not to be unlocked (NO in S2), the process proceeds to step S3, and when the control device 110 judges that the moving body 4 is to be unlocked (YES in S2), the process proceeds to step S4. In the step S3, the control device 110 judges whether it has received an instruction to unlock the moving body 4 (unlock instruction). The unlock instruction is issued to the control device 110 through an input means of the electronic apparatus by, for example, a user of the electronic apparatus operating the input means. The control device 110 stands by until it receives the unlock instruction (repeats the judgment in S3) (NO in S3), and when the control device 110 judges that it has received the unlock instruction (YES in S3), the process proceeds to the step S4.

Figure 13A:
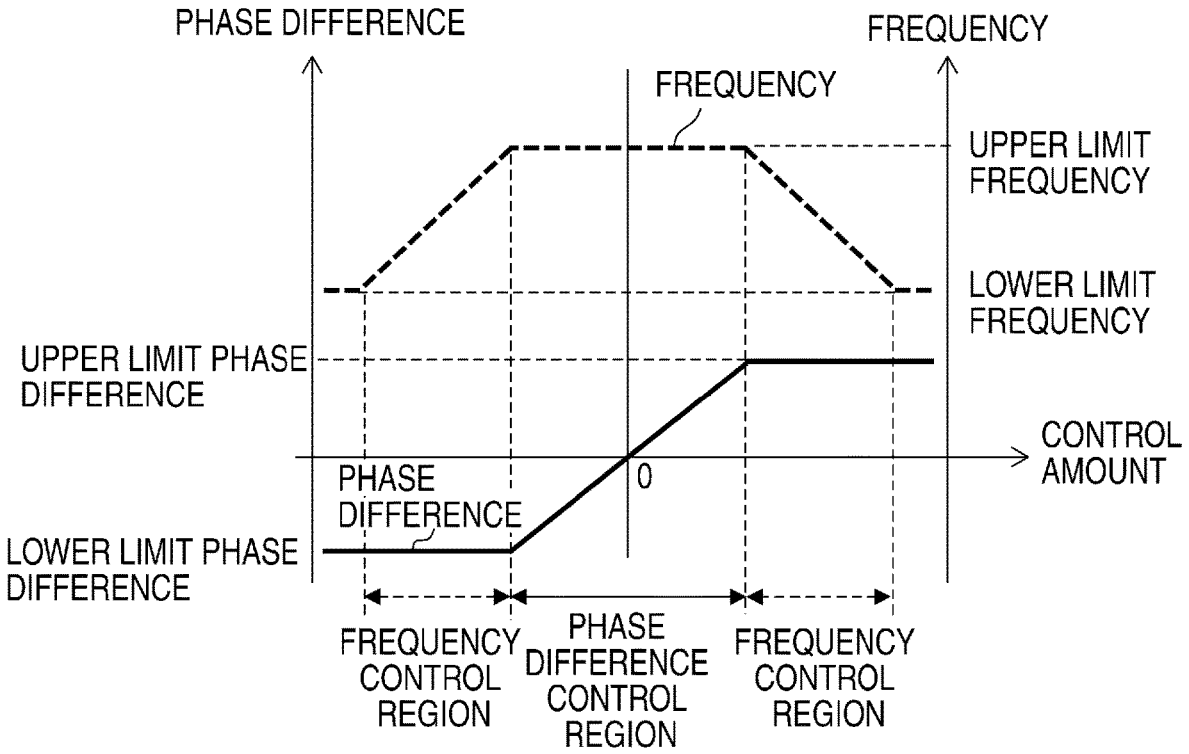
FIG. 13A PRIOR ART
FIGS. 13A and 13B are diagrams useful in explaining a relationship among phase differences, frequencies, and speeds of the vibration-type actuator.
Figure 13B:
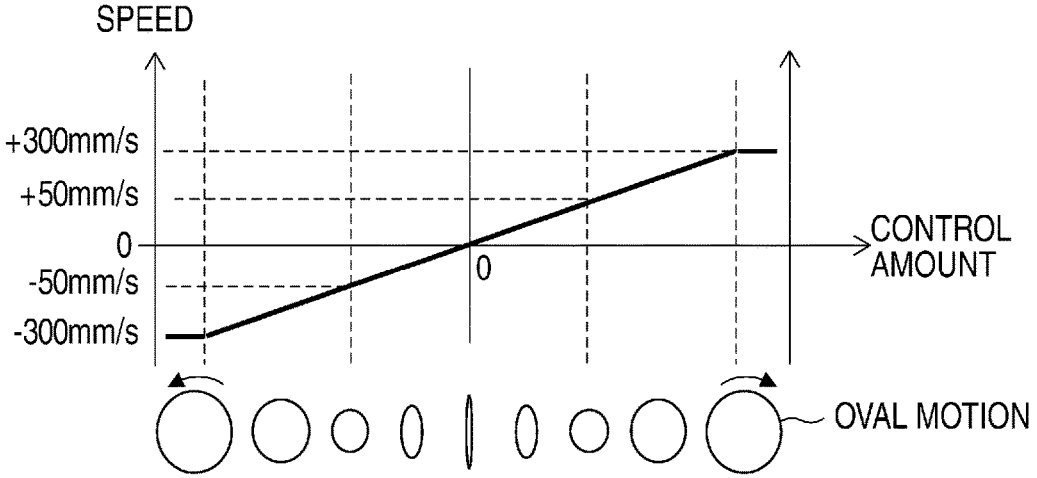
FIG. 13B PRIOR ART

In the step S4, the control device 110 sets a first frequency as a starting frequency, and sets a phase difference between the two modes (the first vibration mode and the second vibration mode described above with reference to FIGS. 12A to 12D) of vibrations excited in the vibrating bodies 30 of the driving units 1A and 1B. The phase difference is set within a range from, for example, −90° to −90°, and more specifically, may be 70° or 110°. Then, in step S5, to unlock the locked moving body 4, the control device 110 starts driving the driving units 1A and 1B under the driving conditions set in the step S4. In step S6, when the second displacement sensor 7 detects the supporting member 2 having moved to a point at which its rotational angle has reached a predetermined angle $\theta=\theta_1$, the control device 110 stops driving the driving units 1A and 1B, and as a result, the unlocking operation is stopped. In the unlocking operation, in order to reliably move the moving body 4, greater importance is placed on thrust than on speed, and only the phase difference control described above with reference to FIGS. 13A and 13B is used. As a result, the supporting member 2 is positioned while what is called the amount of overshoot is minimized.

In step S7, the control device 110 resets positions detected by the first displacement sensors 6*a* and 6*b* and the second displacement sensor 7 in the unlocked state as origin points for use in a translational motion of the moving body 4. Specifically, $X=X_1$ and $Y=Y_1$ detected when the unlocking operation was ended in the step S6 are reset to $X\rightarrow X_0$ and $Y\rightarrow Y_0$. As for θ, however, the detected $\theta_1$ is stored as it is because it is needed for the locking operation. It should be noted that the amount of movement of the moving body 4 in the directions of the x-axis and the y-axis may be controlled such that the moving body 4 is placed at a position where $X=X_0$ and $Y=Y_0$. The amount of movement in the directions of the x-axis and the y-axis may be controlled either immediately after the unlocking operation or by controlling the movement in the directions of the x-axis and the y-axis during the unlocking operation. In this case, values of $X_0$ and $X_1$ and values of $Y_0$ and $Y_1$ of the moving body 4 are substantially equal in the locked state and the unlocked state, and it is thus possible to skip resetting the origin points in the step S7.

Then, in step S8, the control device 110 sets a second frequency, a third frequency, and a phase difference. The phase difference in the step S8 is set within a wider range than the range of phase differences set in the step S4, for example, a range from −120° to 120°.

Figure 8:
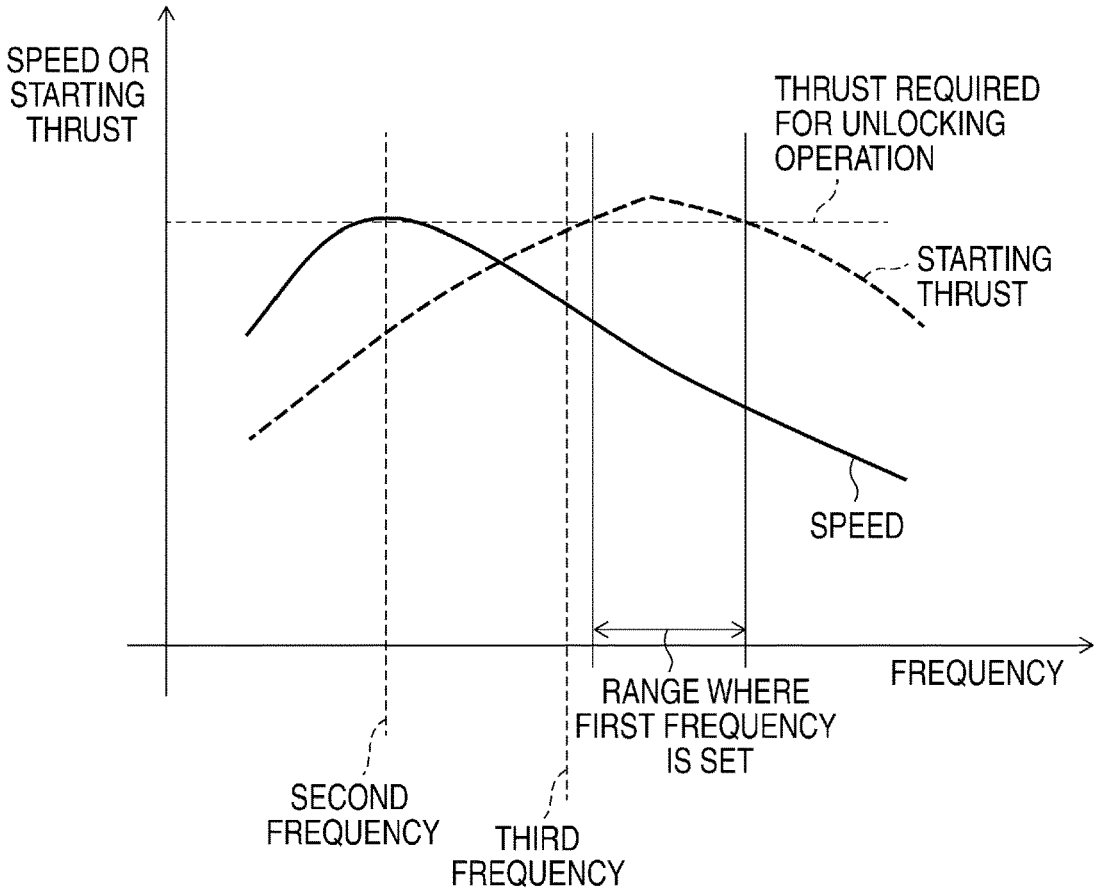
FIG. 8 is a diagram showing characteristics of starting thrust and no-load speed with respect to driving frequencies of the driving units.

A description will now be given of the first frequency set in the step S4 and the second frequency and the third frequency set in the step S8. FIG. 8 is a diagram showing results obtained by measuring starting thrust and no-load speed of the driving unit 1 while changing driving frequencies. The starting thrust, which is indicated by broken lines in FIG. 8, is a thrust generated in the driving unit 1 when a predetermined load (for example, 1 kgf) is imposed on the slider 29 of the driving unit 1. It should be noted that the starting thrust may be measured by measuring a strength of a force with which the slider 29 pulls a load cell of a tensile tester, which is connected to the slider 29, when the slider 29 is driven. The no-load speed, which is indicated by a solid line in FIG. 8, means a speed of the slider 29 when the slider 29 of the driving unit 1 is moved back and forth with no external load being imposed upon it. It is apparent from FIG. 8 that there is a discrepancy (difference) between a driving frequency at which the starting thrust reaches its peak and a driving frequency at which the no-load speed reaches its peak. Here, it is assumed that a range of frequencies at which the starting thrust is greater than thrust required for the unlocking operation is a first frequency range, and an arbitrary frequency within this range is set as the first frequency. Likewise, a frequency at which the no-load frequency speed reaches its peak is set as the second frequency.

As for the third frequency, if the third frequency is matched to the first frequency, an area where thrust is the greatest could be used, but speed cannot be instantaneously increased. On the other hand, if the third frequency is matched to the second frequency, an area where speed is the highest could be used, but thrust would be decreased, making starting impossible. In general, power consumption increases as a driving frequency becomes closer to a resonance frequency. For this reason, in the image pickup apparatus 200 in which the translational driving apparatus 100 is incorporated as an image stabilizer as described above, the amount of extra power allowed to be used for other purposes such as auto-focusing and zooming is considered to be small. It is thus preferred that power required for driving in the translational driving apparatus 100 is low. In consideration of a balance among three elements i.e. speed, thrust, and power consumption, it is preferred that the third frequency is a frequency intermediate between the first frequency and the second frequency as shown in FIG. 8. For example, a frequency that is 2.0 kHz higher than the second frequency is set as the first frequency, and a frequency that is 1.0 kHz higher than the second frequency is set as the third frequency.

It should be noted that under the influence of, for example, machining tolerances for the elastic body, the piezoelectric device, and so forth which are the constituent components of the vibrating body 30 constituting the driving unit 1, the vibrating body 30 has individual differences in characteristics such as a resonance frequency. For this reason, the first frequency, the second frequency, and the third frequency may be different among the four driving units 1A and 1B. It is thus preferred that for each of the four driving units 1A and 1B, a starting thrust and a no-load speed are measured, and based on results of the measurement, the first frequency, the second frequency, and the third frequency are set for each of the four driving units 1A and 1B. In the translational driving apparatus 100, even when the frequencies are set in this manner, a difference among the frequencies is held to about 1.0 kHz at most. It should be noted that when the four driving units 1A and 1B have substantially the same characteristics, values common to all of the four driving units 1A and 1B are allowed to be used for respective ones of the first frequency, the second frequency, and the third frequency.

Referring again to FIG. 7, the control device 110 judges in step S9 whether an instruction to drive the moving body 4 has been issued. For example, when the translational driving apparatus 100 is incorporated as the image stabilizer in the image pickup apparatus 200, an acceleration sensor provided in the image pickup apparatus 200 or the image stabilizer detects image blurring. Then, the control device 110 of the image pickup apparatus 200 sends an instruction to drive the moving body 4 to the translational driving apparatus 100 so as to correct for the image blurring. When the translational driving apparatus 100 is used for a stage such as an XY table, an input signal that moves the stage in a predetermined direction is the instruction to drive the moving body 4. The control device 110 stands by until the instruction to drive the moving body 4 is issued (NO in S9), and when the control device 110 judges that the instruction to drive the moving body 4 has been issued (YES in S9), the process proceeds to step S10.

In the step S10, the control device 110 starts driving the moving body 4. In the step S11, the control device 110 sets a control amount so that required travel distance, travel direction, and speed of the moving body 4 can be obtained, calculates a command speed, and controls the phase difference using the third frequency as the starting frequency so that the command speed can be obtained. In the phase difference control, as described with reference to FIGS. 13A and 13B, the phase difference increases when an absolute value of the control amount increases. For this reason, when the phase difference reaches an upper limit or a lower limit determined in advance, it is necessary to switch from the phase difference control to the frequency control. Thus, in step S12, the control device 110 compares displacements detected by the first displacement sensors 6*a* and 6*b*, and the second displacement sensor 7 with the control amount set in the step S11 to judge whether or not a deviation between the control amount and an amount of movement of the moving body 4 is equal to or greater than a predetermined threshold value. When the control device 110 judges that the deviation is equal to or greater than the threshold value (YES in S12), the process proceeds to step S13, and when the control device 110 judges that the deviation is smaller than the threshold value (NO in S12), the process proceeds to step S14.

In the step S13, the control device 110 provides control to change the driving frequency. By, for example, fixing the phase difference at −120° or 120° and setting a lower limit frequency as the second frequency, the control device 110 prevents the speed from decreasing due to the driving frequency being excessively lowered. In the step S14, the control device 110 judges whether or not driving of the moving body 4 has been completed. The control device 110 judges that the driving of the moving body 4 has been completed when it judges that, based on detection signals from the first displacement sensors 6*a* and 6*b* and the second displacement sensor 7, the moving body 4 has moved to a target position. When the control device 110 judges that the driving of the moving body 4 has not been completed (NO in S14), the process returns to the step S9, and when the control device 110 judges that driving of the moving body 4 has been completed (YES in S14), the process proceeds to step S15.

In the step S15, the control device 110 judges whether or not to lock the moving body 4. For example, in the image pickup apparatus 200 in which the translational driving apparatus 100 is incorporated as the image stabilizer, when an instruction (operation) to turn the power off is issued, the power is turned off after the moving body 4 is locked. Upon judging that the moving body 4 is not to be locked (NO in S15), the control device 110 ends the present process, and when the control device 110 judges that the moving body 4 is to be locked (YES in S15), the process proceeds to step S16. In the step S16, the control device 110 sets the first frequency as the starting frequency for the driving units 1A and 1B and sets a phase difference between them. In step S17, the control device 110 starts driving the driving units 1A and 1B under the driving conditions set in the step S16.

In step S18, the control device 110 stops the locking operation when the amount of rotation reaches $\theta=\theta_0$, completing the present process. At this time, when the moving body 4 does not lie at the position $(X_0, Y_0)$, the engaging pins 8 push the moving body 4 to the position $(X_0, Y_0)$. In this case, frictional load is generated between the engaging pins 8 and the moving body 4, and a greater force is required. For this reason, before the locking operation is performed, control may be provided such that $X=X_0$ and $Y=Y_0$. As a result, frictional load is generated only when the engaging pins 8 and the engaging portions 9 are engaged together as a final step of the locking operation, and therefore, only a small force is required for the locking operation.

Figure 9:
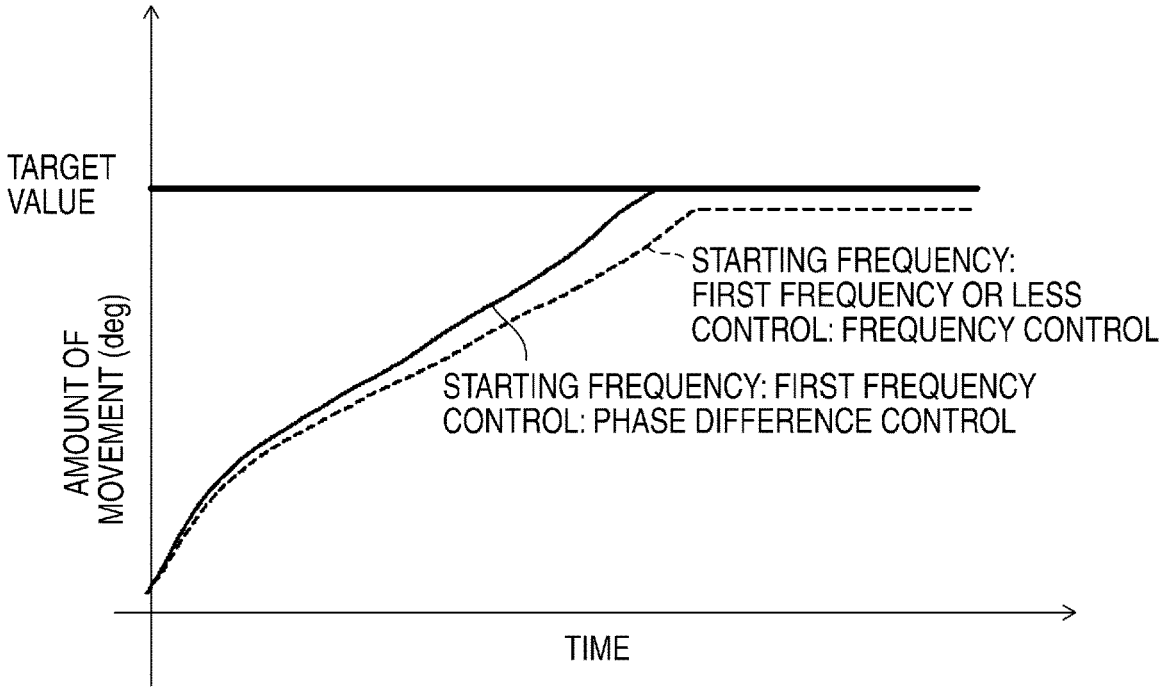
FIG. 9 is a graph showing a relationship between driving conditions and the rotational amount of a supporting member when the moving body is locked in the translational driving apparatus.

FIG. 9 is a graph showing a relationship between driving conditions and the rotational amount of the supporting member 2 when the moving body 4 is locked. Broken lines in FIG. 9 indicate a reference example of a result obtained when the frequency control is provided with a frequency range of 96 kHz to 95 kHz (the starting frequency is the third frequency, and the lower limit frequency is the second frequency). In this case, the moving body 4 stops short of reaching a target value. On the other hand, a solid line in FIG. 9 indicates an example of a result obtained when the moving body 4 is driven using only the phase difference control with the first frequency set to 97 kHz, and in this case, the moving body 4 is reliably moved to the target value. For these reasons, the effect of the phase difference control is maximized by making the phase difference small at the time of starting and making the phase difference large when the load is high (for example, when the speed lowers or when driving is impossible). Thus, providing control to obtain much thrust in locking the moving body 4 enables designing that increases frictional force when the engaging pins 8 and the engaging portions 9 are engaged together and makes it possible to lock the moving body 4 with greater force.

Figure 10A:
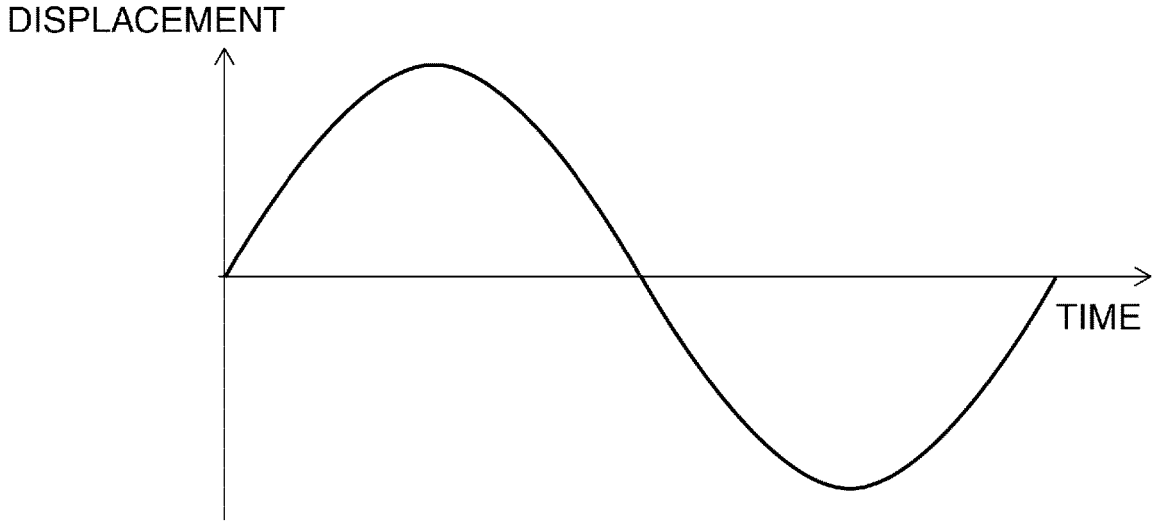
FIGS. 10A and 10B are graphs showing a relationship between command values and displacements when the translational driving apparatus is operating.
Figure 10B:
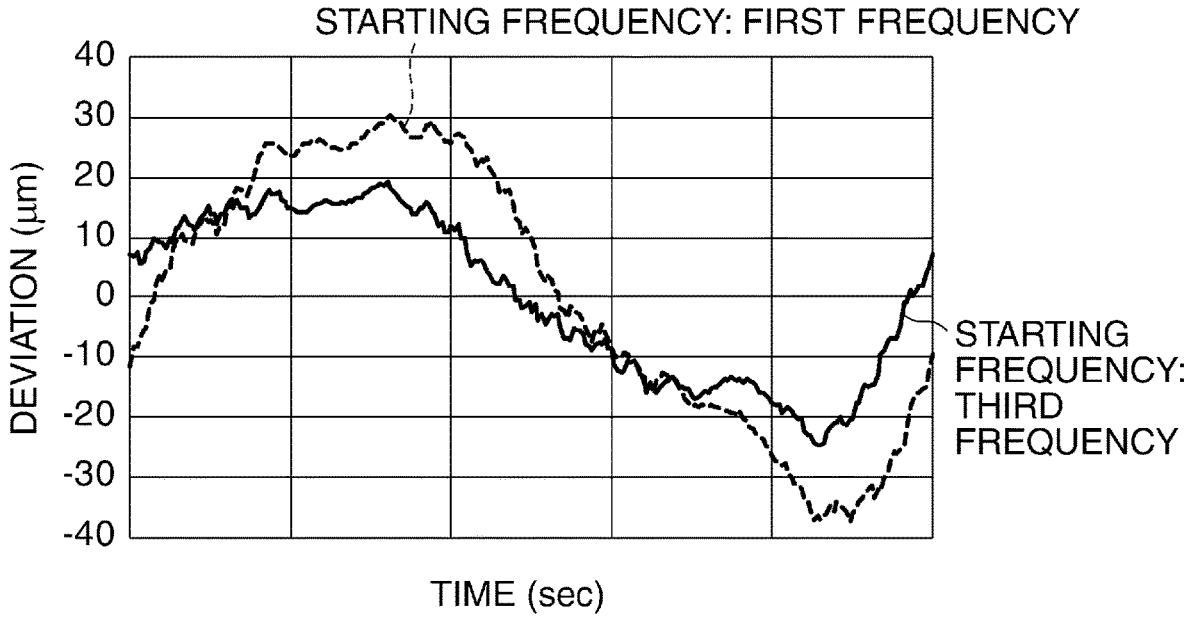

FIGS. 10A and 10B are graphs showing a relationship between command values and actual displacements when the translational driving apparatus 100 in FIG. 5 which acts as the image stabilizer is operating. FIG. 10A is a plot of command values when a sine wave is generated as blurring. FIG. 10B is a graph showing influences of starting frequencies on deviations (correction accuracies) when command values are corrected for blurring. A broken-line graph in FIG. 10B shows a result obtained when the translational driving apparatus 100 is operated using the phase difference control and the frequency control with the starting frequency set to the first frequency (for example, 97 kHz) and the minimum frequency set to the second frequency (for example, 95 kHz). On the other hand, a solid-line graph in FIG. 10B shows a result obtained when the translational driving apparatus 100 is operated using the phase difference control and the frequency control with the starting frequency set to the third frequency (for example, 96 kHz) and the minimum frequency set to the second frequency (for example, 95 kHz). As apparent from the figure, absolute values of deviations are small when the starting frequency is low (the solid-line graph), and this indicates that blurring is corrected for with high accuracy because deviations from target values are small. Namely, in image stabilization, large-amplitude blurring or high-frequency blurring is corrected for with high accuracy by using a frequency range close to the resonance frequency and providing control to increase the speed of the moving body 4 as distinct from the locking operation and the unlocking operation.

As described above, in the present embodiment, when the load is high at the time of starting or the load varies to a large extent, the driving units 1A and 1B are started at such a frequency that thrust is high and are driven at low speed by controlling phase differences. On the other hand, when the load is low or the load varies to a small extent, the driving units 1A and 1B are driven by controlling phase differences or frequencies within a range from a frequency at which thrust is high to the resonance frequency. In a concrete example thereof, to lock the moving body 4 in the translational driving apparatus 100, a greater importance is placed on thrust than on speed, and hence only the phase difference control using the first frequency at which thrust reaches its peak is provided without providing the frequency control that would lower thrust. This reliably locks the moving body 4 and prevents the moving body 4 from becoming inoperable. Moreover, to drive the moving body 4 while keeping it unlocked, the frequency control as well is provided so as to include the second frequency at which the speed of the moving body 4 reaches its peak as described with reference to FIGS. 10A and 10B, and this enables operation at high speed and with high accuracy.

Figure 11:
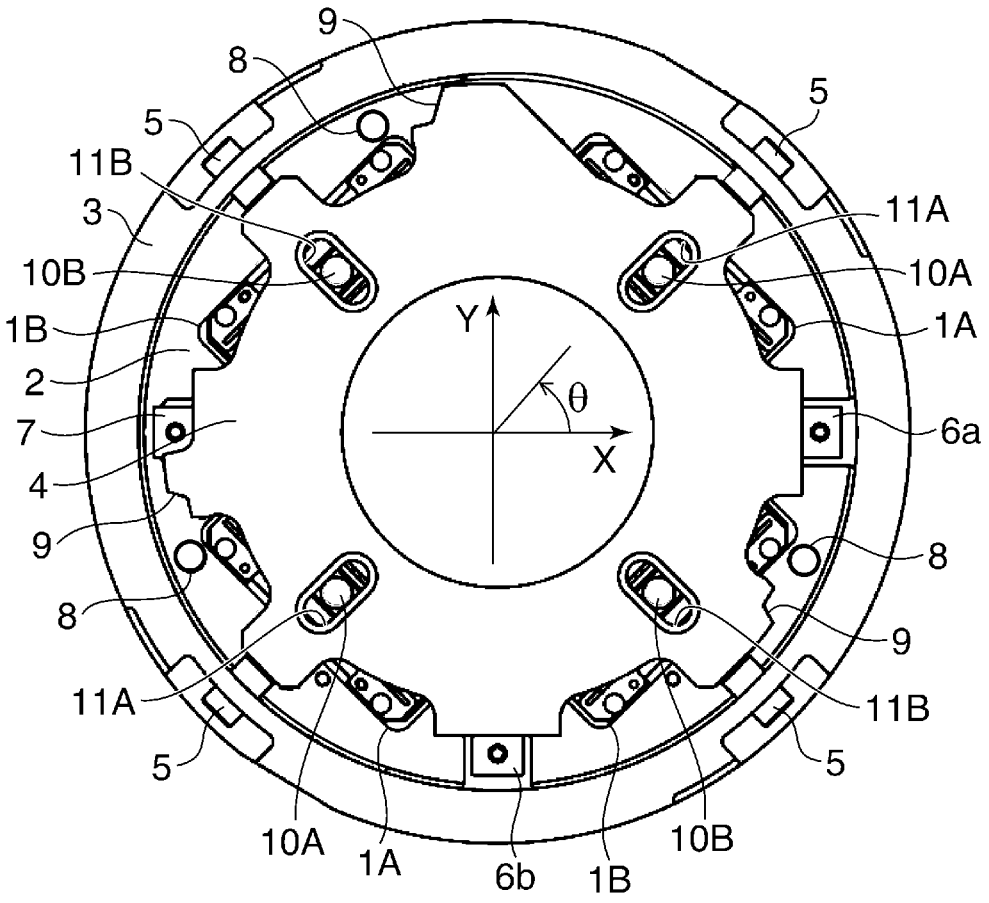
FIG. 11 is a plan view schematically showing an arrangement of another translational driving apparatus.
Figure 12A:
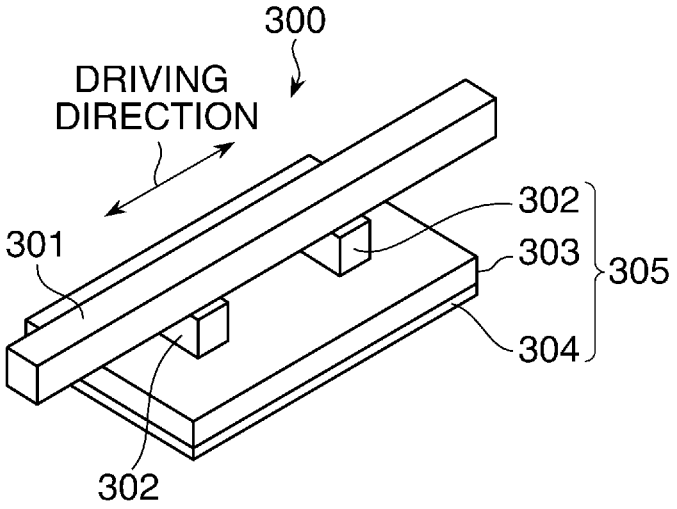
FIG. 12A PRIOR ART
FIGS. 12A to 12D are views useful in explaining an outline of an arrangement and an operating principle of a well-known vibration-type actuator.
Figure 12B:
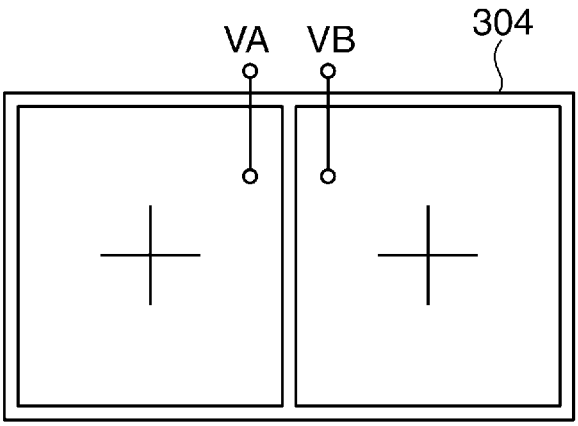
FIG. 12B PRIOR ART
Figure 12C:
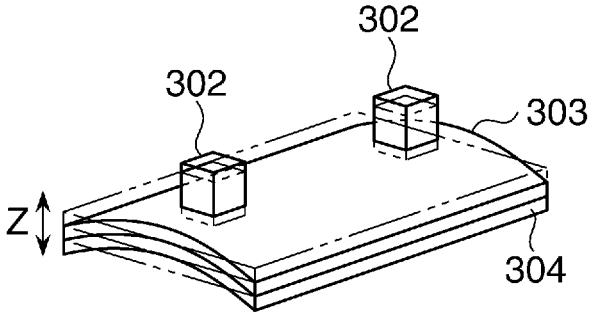
FIG. 12C PRIOR ART
Figure 12D:
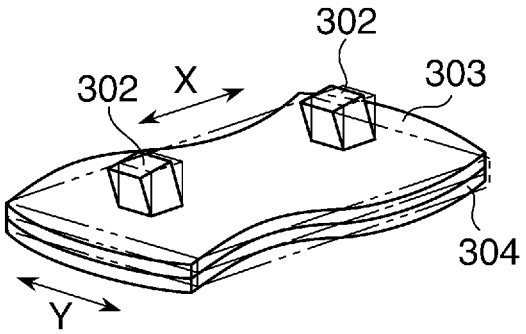
FIG. 12D PRIOR ART

A description will now be given of a variation of the translational driving apparatus 100 described above. FIG. 11 is a plan view schematically showing an arrangement of a translational driving apparatus 100A. The translational driving apparatus 100A differs from the translational driving apparatus 100 in FIG. 2 in that the translational driving apparatus 100A does not have the rotation restraining unit 40 which the translational driving apparatus 100 has, and the supporting member 2 is not rotatable with respect to the fixing member 3, but they are the same in other respects. Therefore, the same component elements of the translational driving apparatus 100A as those of the translational driving apparatus 100 are designated by the same reference symbols, and description thereof is omitted. Only operations unique to the translational driving apparatus 100A will be described. It should be noted that as compared to the translational driving apparatus 100, the translational driving apparatus 100A is easy to assemble due to reduced parts count, brings about a reduction in costs, and is driven with high accuracy due to sliding load being lowered.

The translational driving apparatus 100A is drivingly controlled in accordance with the flowchart of FIG. 7, but how the moving body 4 of the translational driving apparatus 100A is locked differs from how the moving body 4 of the translational driving apparatus 100 is locked. Specifically, as with the translational driving apparatus 100, the supporting member 2 of the translational driving apparatus 100A is equipped with the three engaging pins 8, and the three engaging portions 9 are formed in the moving body 4. It is thus necessary to engage the engaging pins 8 and the engaging portions 9 together with frictional force so as to lock the moving body 4. Here, the translational driving apparatus 100A is able to rotate the moving body 4 since it does not have the rotation restraining unit 40. Thus, as shown in FIG. 4E, by generating driving forces, which are for driving the moving body 4 counterclockwise, in the driving units 1A and 1B, the moving body 4 is rotated counterclockwise to engage the engaging pins 8 and the engaging portions 9 together, causing the moving body 4 to be locked. To unlock the locked moving body 4, the driving units 1A and 1B should be driven so as to rotate the moving body 4 clockwise. It should be noted that by storing an amount by which the moving body 4 is rotated when it is locked, and rotating the moving body 4 by an amount equal to the stored amount at the time of the unlocking operation, the moving body 4 is brought back to a state before it was locked. The moving body 4 is reliably driven by adopting the conditions in the steps S4 and S16 in FIG. 7 for the unlocking operation and the locking operation, respectively, for the moving body 4 of the translational driving apparatus 100A.

It should be noted that in the embodiment described above, the plurality of driving units 1 is used to drive the moving body 4 which is the object to be driven, the object to be driven may be the sliders 29 (driven bodies) constituting the driving units 1. Namely, the control method for the vibration-type actuator according to the present invention described with reference mainly to FIGS. 7 to 10B can be used as long as the sliders 29 are driven under relatively low load and under relatively high load. Moreover, the control method for the vibration-type actuator according to the present invention may be used to drivingly control a vibration-type actuator that has a different structure from that of the vibration-type actuator 300 described with reference to FIGS. 12A to 12D. For example, the present invention may also be applied to a vibration-type actuator in which an annular vibrating body and a driven body are brought into pressure contact with each other, and oval vibrations or progressive waves are generated on frictional sliding surfaces of the vibrating body and the driven body to rotate and displace the vibrating body and the driven body relatively to each other.

Further, the image stabilizer of the image pickup apparatus and the stage such as an XY table were taken up as an application example of the translational driving apparatus 100 using the driving units 1. This, however, is not limitative, but the translational driving apparatus 100 may be applied to various types of electronic equipment which have members required to be driven and positioned within an XY plane. Moreover, although in the above examples, the translational driving apparatuses 100 and 100A are configured to have the four driving units 1, the number of driving units 1 may be, for example, three, and in this case as well, the same control is provided as in the case where the number of driving units is four.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-197199, filed Oct. 5, 2016 which is hereby incorporated by reference herein in its entirety.

What is claimed is:

1. A vibration-type driving apparatus comprising:

a vibration-type actuator configured to have a vibrating body that has an electro-mechanical energy conversion element, and a contact body that is in contact with the vibrating body, and move the vibrating body and the contact body relatively to each other by exciting vibrations in the vibrating body through application of AC voltage to the electro-mechanical energy conversion element; and a control device configured to control the vibration-type actuator by controlling the AC voltage, the control device being configured to control a starting frequency of the AC voltage in a first case such as to be different from the starting frequency in a second case, in which a load for moving the vibrating body and the driven body relatively to each other is lower than that of the first case, drive the vibration-type actuator in the first case by setting the starting frequency to a first frequency, which falls within a frequency range including a frequency at which thrust of the vibration-type actuator reaches its peak, and drive the vibration-type actuator in the second case by setting the starting frequency to a third frequency lower than the first frequency and higher than a second frequency, the second frequency being a frequency at which a moving speed at which the driving body and the contact body relatively move to each other reaches its peak.

2. The vibration-type driving apparatus according to claim 1, wherein the first frequency is a frequency within a range of frequencies at which thrust higher than the load is produced.

3. The vibration-type driving apparatus according to claim 1, wherein the second frequency is a frequency at which a speed at which the vibrating body and the contact body are moved relatively to each other when no external load is applied to the contact body reaches its peak.

4. The vibration-type driving apparatus according to claim 1, wherein in the first case, the control device controls phase differences of the first frequency within a range from an upper limit value to a lower limit value of phase differences set in advance.

5. The vibration-type driving apparatus according to claim 1, wherein in the second case, the control device controls a speed at which the vibrating body and the contact body move relatively to each other by changing phase differences of the third frequency in a range from an upper limit value to a lower limit value of phase differences set in advance.

6. The vibration-type driving apparatus according to claim 5, wherein in a third case where a phase difference of the AC voltage reaches the upper limit value or the lower limit value of phase differences set in advance, the control device controls a speed at which the vibrating body and the contact body move relatively to each other by changing frequencies of the AC voltage with the second frequency set as a lower limit.

7. The vibration-type driving apparatus according to claim 1, wherein the first case means a case where an operation to engage the vibrating body or the contact body with a predetermined place through friction or release the engagement is performed, and wherein the second case means a case where an operation to move the vibrating body and the contact body relatively to each other while maintaining a state in which the engagement of the vibrating body or the contact body through friction is released is performed.

8. The vibration-type driving apparatus according to claim 1, further comprising:

a moving body;

a plurality of driving units configured to have the vibration-type actuator; and a supporting member configured to support the plurality of driving units, wherein the moving body and the supporting member are placed so as to be movable relatively to each other by the moving body receiving outputs from the plurality of driving units, the first case means a case where an operation to engage the moving body with a predetermined place through friction or release the engagement is performed, and the second case means a case where an operation to move the driving units and the moving body relatively to each other while maintaining a state in which the engagement of the moving body through friction is released is performed.

9. The vibration-type driving apparatus according to claim 1, wherein the vibrating body comprises:

a flat-shaped elastic body; and a projecting portion configured to be provided on one side of the elastic body and come into contact with the contact body, wherein the electro-mechanical energy conversion element is provided on the other side of the elastic body, and oval vibrations generated in the projecting portion by exciting vibrations in two different vibration modes in the vibrating body frictionally drive the contact body.

10. A control method for a vibration-type actuator including a vibrating body that has an electro-mechanical energy conversion element, and a contact body that is in contact with the vibrating body, and moves the vibrating body and the contact body relatively to each other by exciting vibrations in the vibrating body through application of AC voltage to the electro-mechanical energy conversion element, the control method comprising:

controlling the vibration-type actuator by controlling the AC voltage;

controlling a starting frequency of the AC voltage in a first case such as to be different from the starting frequency in a second case, in which a load for moving the vibrating body and the driven body relatively to each other is lower than that of the first case, driving the vibration-type actuator in the first case by setting the starting frequency to a first frequency, which falls within a range where thrust of the vibration-type actuator reaches its peak, and driving the vibration-type actuator in the second case by setting the starting frequency to a third frequency lower than the first frequency and higher than a second frequency, the second frequency being a frequency at which a moving speed at which the driving body and the contact body move relatively to each other reaches its peak.

11. An electronic apparatus comprising:

a vibration-type driving apparatus; and a member configured to be positioned using output from a vibration-type actuator which the vibration-type driving apparatus has, wherein the vibration-type driving apparatus comprises the vibration-type actuator including a vibrating body that has an electro-mechanical energy conversion element, and a contact body that is in contact with the vibrating body, and moves the vibrating body and the contact body relatively to each other by exciting vibrations in the vibrating body through application of AC voltage to the electro-mechanical energy conversion element, and a control device that controls the vibration-type actuator by controlling the AC voltage, the control device being configured to control a starting frequency of the AC voltage in a first case such as to be different from the starting frequency in a second case, in which a load for moving the vibrating body and the driven body relatively to each other is lower than that of the first case, drive the vibration-type actuator in the first case by setting the starting frequency to a first frequency, which falls within a frequency range including a frequency at which thrust of the vibration-type actuator reaches its peak, and drive the vibration-type actuator in the second case by setting the starting frequency to a third frequency lower than the first frequency and higher than a second frequency, the second frequency being a frequency at which a moving speed at which the driving body and the contact body move relatively to each other reaches its peak.

* * * * *